US005984198A

United States Patent [19]

Bennett et al.

[11] Patent Number: 5,984,198

[45] Date of Patent: Nov. 16, 1999

[54] HEAT PUMP APPARATUS FOR HEATING LIQUID

[75] Inventors: Gregory S. Bennett, Carrollton; Thomas J. Carr, Plano; Merlin K. Chapin, The Colony; Nabil G. Hamad, Richardson, all of Tex.

[73] Assignee: Lennox Manufacturing Inc., Marshalltown, Iowa

[21] Appl. No.: 08/871,785

[22] Filed: Jun. 9, 1997

[51] Int. Cl.[6] ..... G05D 23/00; F25B 27/00

[52] U.S. Cl. ..... 237/2 B; 165/140; 62/238.6

[58] Field of Search ..... 62/238.6–238.7, 62/180, 179; 165/140; 237/2 B

[56] References Cited

U.S. PATENT DOCUMENTS

| | | | |
|---|---|---|---|
| 4,194,368 | 3/1980 | Bahel et al. | 62/335 X |
| 4,391,104 | 7/1983 | Wendschlag | 62/79 |
| 4,507,938 | 4/1985 | Hama et al. | 62/324.1 |
| 4,567,733 | 2/1986 | Mecozzi | 165/140 X |
| 4,598,557 | 7/1986 | Robinson et al. | 62/238.6 |
| 5,255,338 | 10/1993 | Robinson et al. | 392/451 |
| 5,263,892 | 11/1993 | Vandervaart | 62/238.6 X |
| 5,305,614 | 4/1994 | Gilles | 62/238.7 |
| 5,351,502 | 10/1994 | Gilles et al. | 62/238.7 |
| 5,367,602 | 11/1994 | Stewart | 392/308 |
| 5,544,645 | 8/1996 | Armijo et al. | 126/101 |

FOREIGN PATENT DOCUMENTS

WO 81/03219 4/1981 WIPO .

*Primary Examiner*—William Wayner
*Attorney, Agent, or Firm*—W. Kirk McCord

[57] ABSTRACT

Heat pump apparatus for heating liquid, such as water, includes a refrigerant circuit and a water circuit, a refrigerant-to-water heat exchanger and an air-to-refrigerant heat exchanger operably disposed in heat exchange relationship with a air fluid stream of a systemically separate primary source of space conditioning. A compressor is provided for circulating the refrigerant between the two heat exchangers and a water pump is provided for circulating the water to be heated through the refrigerant-to-water heat exchanger. A tank is also provided for storing the heated water. The tank has an electrically resistive heating element operably associated therewith. A control circuit is provided for normally enabling operation of the heat pump and disabling the heating element in response to a demand for liquid heating. However, in response to selected conditions, such as a low outdoor air temperature condition, the control circuit disables the heat pump and enables the heating element in response to a demand for water heating.

14 Claims, 3 Drawing Sheets

HEAT PUMP APPARATUS FOR HEATING LIQUID

TECHNICAL FIELD

This invention relates generally to apparatus for heating liquids and in particular to an improved heat pump apparatus for heating liquid, such as water for domestic use.

BACKGROUND ART

According to statistics promulgated by the Energy Information Administration in 1990, there were approximately 35,000,000 residential water heaters operated by electricity out of a total of approximately 94,000,000 residential water heaters. The high cost of electricity relative to fuels such as natural gas is well known. On an operating cost basis, the cost per Btu of delivered water heating for electrical resistance water heaters is two to two and one-half times that of natural gas-fired water heaters. The concern for reducing energy consumption and conserving natural resources has given rise to a need for cost-effective substitutes for electrical resistance heating of water. Various substitutes for electrical resistance water heating that operate on electricity are known in the water heating industry. These substitutes include (a) solar-assisted water heating systems; (b) desuperheater water heating systems; (c) heat pump water heaters; and (d) fully integrated space conditioning/water heating heat pumps.

Solar-assisted water heating systems employ a bank of solar collectors to heat water with solar radiation. Well-designed solar systems can reduce the cost of heating water by about 50% as compared to electrical resistance heating. While effective from an energy usage standpoint, solar-assisted water heating has not achieved wide-spread usage because of the relatively high initial cost and maintenance costs, the potential for winter freeze-ups and unsightly appearance.

Desuperheater water heaters recover heat from hot compressor discharge vapor of a space conditioning system (which may be a heat pump). A refrigerant vapor-to-water heat exchanger (desuperheater) is inserted in the compressor discharge line of the space conditioning system. One disadvantage of desuperheaters is that when they are applied to a conventional air conditioning system, water heating is available from the desuperheater only when there is a simultaneous requirement for space cooling. If a desuperheater is applied to a heat pump, water heating availability is extended to times when there is a simultaneous requirement for space heating. Further, because a desuperheater is typically located outdoors adjacent to the space conditioning compressor, the water must be drained from the desuperheater during the winter months to prevent freeze-up. Alternatively, the desuperheater must be located remotely from the compressor in a conditioned space, which requires field installation of a set of hot refrigerant pipes between the desuperheater and the outdoor compressor discharge line. Because of the seasonal limitations, potential for winter freeze-ups, intrusion of the desuperheater into the space conditioning system refrigeration circuit and the high cost of field installation, desuperheaters are practical only in climates with extended space cooling requirements and very mild winters.

Dedicated heat pump water heaters heat water by extracting heat, typically from a conditioned space, and utilize heat pumping principles to transfer the heat to the water. In the typical application, indoor air is passed over an air-to-refrigerant heat exchanger that serves as an evaporator of a refrigeration system. The refrigerant vapor is then raised to a higher pressure by the compressor and then condensed in a refrigerant-to-water heat exchanger. During operation, the heat pump water heater generates a cooling effect on the indoor air passing over the air-to-refrigerant heat exchanger. This cooling effect is desirable when space cooling is required, but the cooling effect must be offset by additional space heating during the winter months. Further, in applications where air is drawn from and returned to the immediate indoor ambient environment, local cool spots may develop inside the structure. If the air-to-refrigerant heat exchanger is located outdoors, it is susceptible to frosting in winter. In addition to the problem of cool spots inside the structure or outdoor coil frosting, the dedicated heat pump water heater has a relatively high initial cost, which has limited its commercial acceptance.

Fully integrated space conditioning/water heating heat pumps provide both space conditioning and water heating. Such integrated systems also typically include a desuperheater, which is used for water heating when there is a simultaneous call for space conditioning and water heating. When there is no space conditioning demand, the system functions as a heat pump water heater. Integrated space conditioning/water heaters have not met with commercial success because of the complex piping and controls required and the relatively high initial cost.

An improved heat pump apparatus for heating liquids, such as water, is described in U.S. Pat. No. 5,305,614, assigned to Lennox Industries Inc. The heating apparatus includes two heat exchangers, one being a refrigerant-to-water heat exchanger external to a conventional hot water storage tank and the other being an air-to-refrigerant heat exchanger disposed in the return fluid stream of a systemically separate space conditioning system. Neither the space conditioning system nor the hot water storage tank need to be modified to accommodate the heat pump apparatus. In operation, heat is transferred from the return fluid stream to the refrigerant, which in turn transfers heat to the water, thereby providing "free" cooling of the return fluid stream and reducing the load on the space conditioning system when there is a demand for space cooling. In contrast to dedicated heat pump water heaters discussed hereinabove, the cooling by-product is not dumped into a conditioned space at one location, but rather is distributed throughout an indoor space by the space conditioning system ducting. One disadvantage of this type of heating apparatus is that when there is a demand for water heating, the indoor blower of the space conditioning system is activated to provide the return fluid stream. Because heating the water requires the return fluid stream to be cooled, cooled air is supplied to the indoor space, even when there is no demand for space cooling.

The present invention is directed to an improvement in the heat pump water heater described in U.S. Pat. No. 5,305,614.

SUMMARY OF THE INVENTION

In accordance with another feature of the invention, the liquid heating apparatus includes a tank for storing liquid heated by the heat pump apparatus. A first temperature sensor is operably associated with the tank and is adapted to generate a demand for liquid heating signal in response to the temperature of liquid stored in the tank being below a predetermined temperature. An electrically resistive heating element is also operably associated with the tank to heat the liquid stored therein. The control device normally enables operation of the second and third circulation devices to heat liquid in the second circuit and disable operation of the heating element in response to the demand for liquid heating signal. A second temperature sensor is provided to measure outdoor air temperature and to generate a low air temperature signal in response to the outdoor air temperature being below a predetermined threshold temperature. The control device is adapted to disable operation of the second and third circulation devices and to enable operation of the heating element in response to the presence of both the demand for liquid heating signal and the low air temperature signal. In accordance with yet another feature of the invention, a third temperature sensor is provided for measuring outdoor air temperature. The control device operates the third circulation device to circulate liquid in the third circuit in response to the outdoor air temperature measured by the third temperature sensor being below a predetermined temperature, irrespective of whether there is a demand for liquid heating.

In accordance with the present invention, heat pump apparatus is provided for heating liquid in combination with a system for temperature conditioning an indoor space. The space conditioning system includes first and second heat exchangers; a first circulation device (e.g., a compressor) for circulating a first heat transfer fluid (e.g., a vapor compression refrigerant) in a first circuit between the first and second heat exchangers; and a fluid moving device (e.g., a blower ) operable to supply a stream of conditioning fluid (e.g., air) to the indoor space at first and second flow rates. The first flow rate corresponds to a lower flow rate than the second flow rate. The first heat exchanger is in heat exchange relationship with a return stream of the conditioning fluid for transferring heat between the first heat transfer fluid and the return stream. The second heat exchanger is preferably an outdoor heat exchanger.

The heat pump apparatus for heating liquid (e.g., potable water for domestic use) includes a third heat exchanger; a second circulation device (e.g., a compressor) for circulating a second heat transfer fluid (e.g., a vapor compression refrigerant) in a second circuit between the stream of conditioning fluid and the third heat exchanger; and a third circulation device (e.g., a liquid pump) for circulating the liquid to be heated in a third circuit through the third heat exchanger, whereby heat is transferred to the liquid from the stream of conditioning fluid via the second heat transfer fluid in the third heat exchanger. A control device is provided to control the second circulation device to circulate the second heat transfer fluid in the second circuit and the third circulation device to circulate the liquid in the third circuit in response to a demand for liquid heating.

In accordance with a feature of the invention, the control device is operable to control the fluid moving device to supply the stream of conditioning fluid at the first flow rate in response to the demand for liquid heating when the first circulation device is not being operated and to control the fluid moving device to supply the stream of conditioning fluid at the second flow rate when the first circulation device is being operated, irrespective of whether there is a demand for liquid heating.

In accordance with still another feature of the invention, a manually operable switch is provided, which is positionable in open and closed positions. The control device is further adapted to enable operation of the second and third circulation devices in response to the demand for liquid heating signal when the manually operable switch is in the closed position, irrespective of whether the low air temperature signal is present.

In accordance with a further feature of the invention, a pressure switch is provided to measure pressure of the heat transfer fluid in the second circuit on a discharge side of the second circulation device and to generate a high pressure signal in response to the measured pressure exceeding a predetermined pressure. The control device is further adapted to disable the second and third circulation devices and to enable the heating element in response to the presence of both the high pressure signal and the demand for liquid heating signal.

The present invention provides improved apparatus for heating liquid, such as water. The apparatus includes both a heat pump and a conventional electrically resistive heating element. The heat pump and heating element are coordinately controlled so that under normal circumstances in response to a demand for liquid heating, the heat pump is operated and the heating element is disabled. However, under certain conditions, such as low outdoor air temperature or excessive pressure on the discharge side of the second circulation device, the heating element is used to heat the liquid, instead of the heat pump, in response to a demand for liquid heating.

BEST MODE FOR CARRYING OUT THE INVENTION

The best mode for carrying out the invention will now be described in detail with reference to the accompanying drawings. The drawings are not necessarily to scale and in some instances proportions may have been exaggerated in order to more clearly depict certain features of the invention.

Figure 1:
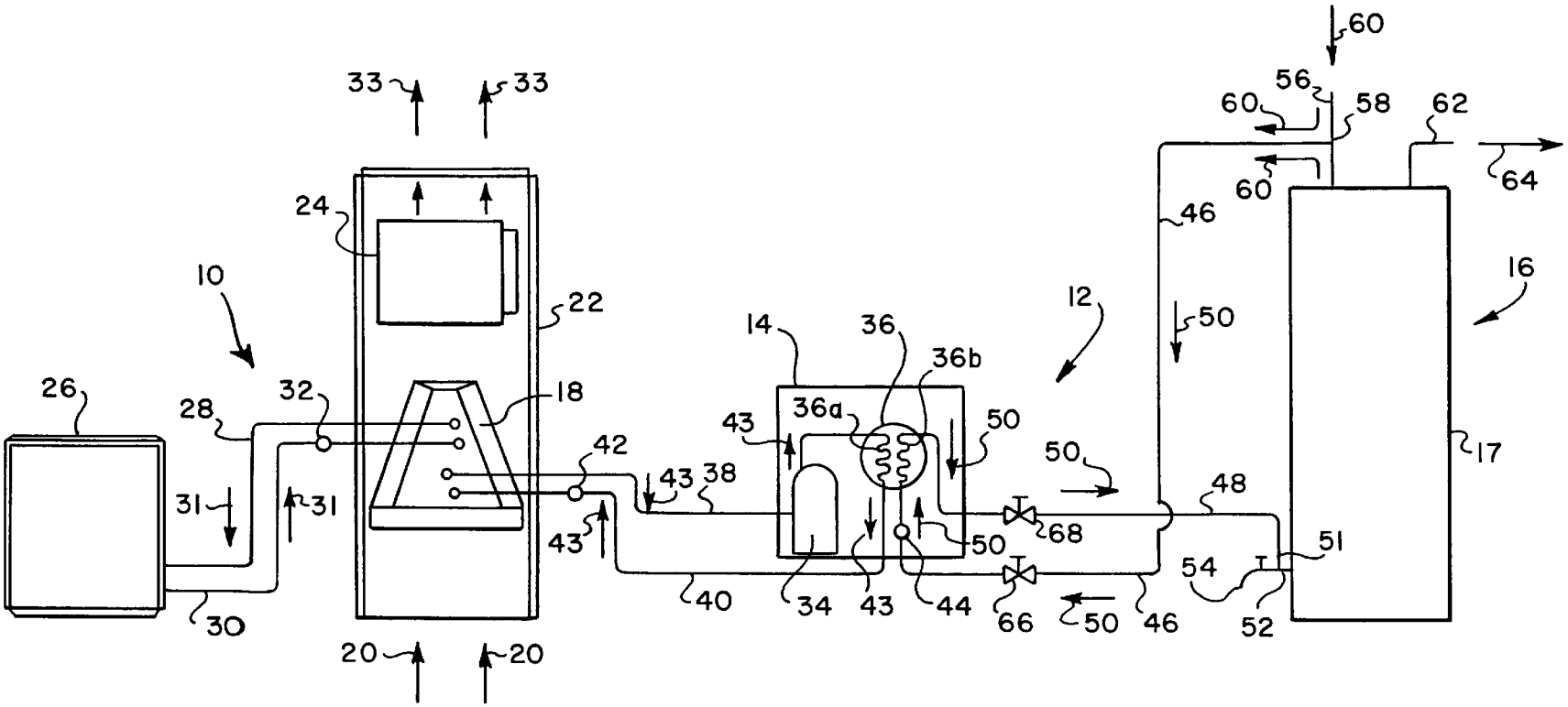
FIG. 1 is a schematic view of a combined space conditioning/water heating system, according to the present invention.

Referring to FIG. 1, a space conditioning system 10 and an apparatus 12 for heating liquid, such as water for domestic use, are depicted schematically. Space conditioning system 10 is the primary source of temperature conditioning for an indoor space. Apparatus 12 includes a heat pump module 14, which is preferably located indoors and external to a conventional hot water heater 16, which includes a water storage tank 17 and one or more electric heating elements (not shown) inside tank 17. The third major component of apparatus 12 is a first heat exchanger 18, which is operably disposed in heat exchange relationship with an unconditioned return fluid stream 20 of space conditioning system 10. Although return fluid stream 20 is shown as a return air stream in FIG. 1, heat exchanger 18 may also be operably disposed in heat exchange relationship with an unconditioned return liquid stream, such as heated or chilled water in a hydronic space conditioning system. Module 14 is operably connected between tank 17 and heat exchanger 18. Heat exchanger 18 is preferably housed within a cabinet 22, along with a conventional motor-driven air blower 24. Blower 24 may be an air blower of the induced draft type, for providing a continuous stream of return air through heat exchanger 18. Heat exchanger 18 is preferably a heat exchanger of the so-called "A-coil" type, which will be described in greater detail hereinafter with reference to FIG. 2.

In accordance with a feature of the invention, heat exchanger 18 is also operably connected with an outdoor unit 26 of space conditioning system 10, such that heat exchanger 18 functions as a component of both space conditioning system 10 and water heating apparatus 12. Outdoor unit 26 may be an outdoor unit of a conventional heat pump, including a compressor (not shown), a refrigerant flow reversing valve (not shown) and refrigerant-to-air second heat exchanger (not shown), which operates as a condenser in the cooling mode and as an evaporator in the heating mode. In an alternate embodiment, outdoor unit 26 may be a condensing unit of a conventional central air conditioning system, including a compressor (not shown) and a refrigerant-to-air second heat exchanger (not shown). If space conditioning system 10 is a heat pump, heat exchanger 18 functions as a condenser to heat the return air stream when system 10 is operated in the heating mode and as an evaporator to cool the return air stream when system 10 is operated in the cooling mode. If space conditioning system 10 is a conventional central air conditioning system, heat exchanger 18 functions as an evaporator to cool the return air stream.

Assuming that space conditioning system 10 is a heat pump, its operation will now be described briefly as follows. The compressor in outdoor unit 26 is operable as a first circulation device to circulate a vapor compression first refrigerant in a first circuit between first heat exchanger 18 and the second heat exchanger in unit 26 via lines 28, 30. Line 28 is on the suction side of the compressor and line 30 is on the discharge side thereof. A conventional refrigerant expansion device 32 is operably disposed in discharge line 30. Arrows 31 indicate the direction of refrigerant flow through lines 28, 30. Blower 24 draws air through heat exchanger 18, which transfers heat either to the air from the refrigerant flowing through heat exchanger 18 or from the air to the refrigerant, depending on whether system 10 is operating in a heating or cooling mode. Arrows 33 illustrate the flow of conditioned air to the indoor space.

The operation of water heating apparatus 12 will now be described briefly as follows. Heat pump module 14 is similar to outdoor unit 26 in that it contains a compressor 34 and a third heat exchanger 36. Heat exchanger 36 is a refrigerant-to-water heat exchanger having coaxial coils 36*a*, 36*b*. Compressor 34 is operable as a second circulation device to circulate a vapor compression second refrigerant in a second circuit between coil 36*a* and heat exchanger 18 via lines 38, 40. Line 38 is on the suction side of compressor 34 and line 40 is on the discharge side thereof. A conventional refrigerant expansion device 42 is operably disposed in discharge line 40. Arrows 43 indicate the direction of refrigerant flow through lines 38, 40.

Module 12 further includes a liquid pump 44, which is operable as a third circulation device to circulate water in a third circuit between coil 36*b* and tank 16 via lines 46, 48. Line 46 is on the suction side of pump 44 and line 48 is on the discharge side thereof. Arrows 50 indicate the direction of water flow through lines 46, 48. Water flowing through coil 36*b* is heated by the hot refrigerant gas flowing through coil 36*a*. The heated liquid is pumped through line 48 back into the bottom part of tank 17 through a tee connection 51 installed in a drain nipple 52 emanating from tank 17. A drain valve 54 is installed at the discharge end of nipple 52.

Cold water is introduced into the top part of tank 17 and into suction line 46 via a liquid supply line 56 and through a tee connection 58. The flow of incoming cold water is illustrated by arrows 60. Heated liquid for domestic use is drawn from the top part of tank 17 through a hot water supply line 62, as illustrated by arrow 64. Gate valves 66, 68 are operably disposed in suction line 46 and discharge line 48, respectively.

Figure 2:
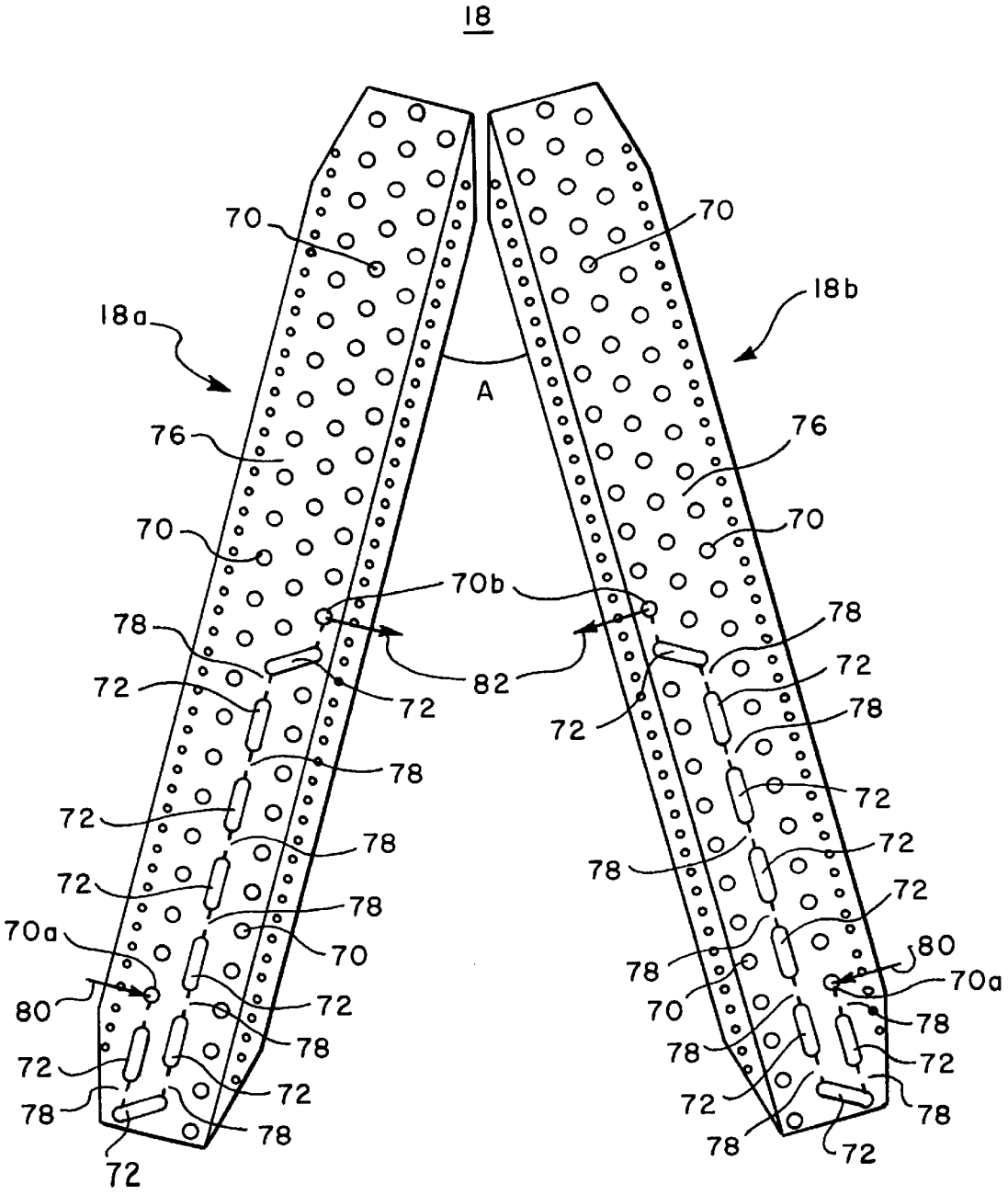
FIG. 2 is an elevational view of an A-coil heat exchanger, which functions as a heat exchanger in both the space conditioning system and the water heating apparatus, according to the present invention.

Referring also to FIG. 2, heat exchanger 18 is depicted in greater detail. Heat exchanger 18 is comprised of a pair of coil slabs 18*a*, 18*b*, which are coupled together at their respective upper ends by a top plate (not shown) and extend downwardly therefrom in divergent relationship to define an angle A therebetween. Each slab 18*a*, 18*b* includes three rows of refrigerant carrying tubes 70 and plural heat transfer enhancing fins (not shown). Tubes 70 are passed through respective openings in the fins and cooperate with the fins to provide multiple paths for return air stream 20 to flow through heat exchanger 18. Tubes 70 are preferably formed as hairpins with return bends 72 connecting distal ends of respective tubes 70. Tubes 70 penetrate through header plates 76 on both the front and back of each slab 18*a*, 18*b*. Only the front header plates 76 are shown in FIG. 2.

Although space conditioning system 10 and water heating apparatus 12 are systemically separate, heat exchanger 18 functions both as an indoor coil for space conditioning system 10 and as an evaporator coil for water heating apparatus 12. To this end, each slab 18*a*, 18*b* includes separate refrigerant circuits for space conditioning system 10 and water heating apparatus 12. The refrigerant circuit dedicated to water heating apparatus 12 is illustrated by dashed lines 78 on each slab 18*a*, 18*b*. The remaining tubes 70 in each slab 18*a*, 18*b* are used to provide one or more refrigerant circuits for space conditioning system 10.

As indicated by inlet arrows 80, refrigerant enters each slab 18*a*, 18*b* through a corresponding tube 70*a*. The refrigerant flows back and forth through the particular tubes 70 of each slab 18*a*, 18*b* which are dedicated to water heating apparatus 12, following the path indicated generally by dashed lines 78. The refrigerant is heated by return air stream 20 and is substantially evaporated as it flows back and forth through heat exchanger 18. Refrigerant exits each slab 18*a*, 18*b* through a corresponding tube 70*b*, as indicated by outlet arrows 82. Although not shown in FIG. 2, one skilled in the art will recognize that plural distributor tubes are in fluid communication with heat exchanger 18 for supplying refrigerant thereto and plural adapter tubes are also in fluid communication with heat exchanger 18 for discharging refrigerant therefrom. Although heat exchanger 18 is shown as being a heat exchanger of the A-coil type, one skilled in the art will recognize that other types of heat exchangers may be used in lieu of the A-coil type. For example, a heat exchanger comprised of a single slab coil may be used in lieu of the A-coil shown in FIG. 2.

Figure 3:
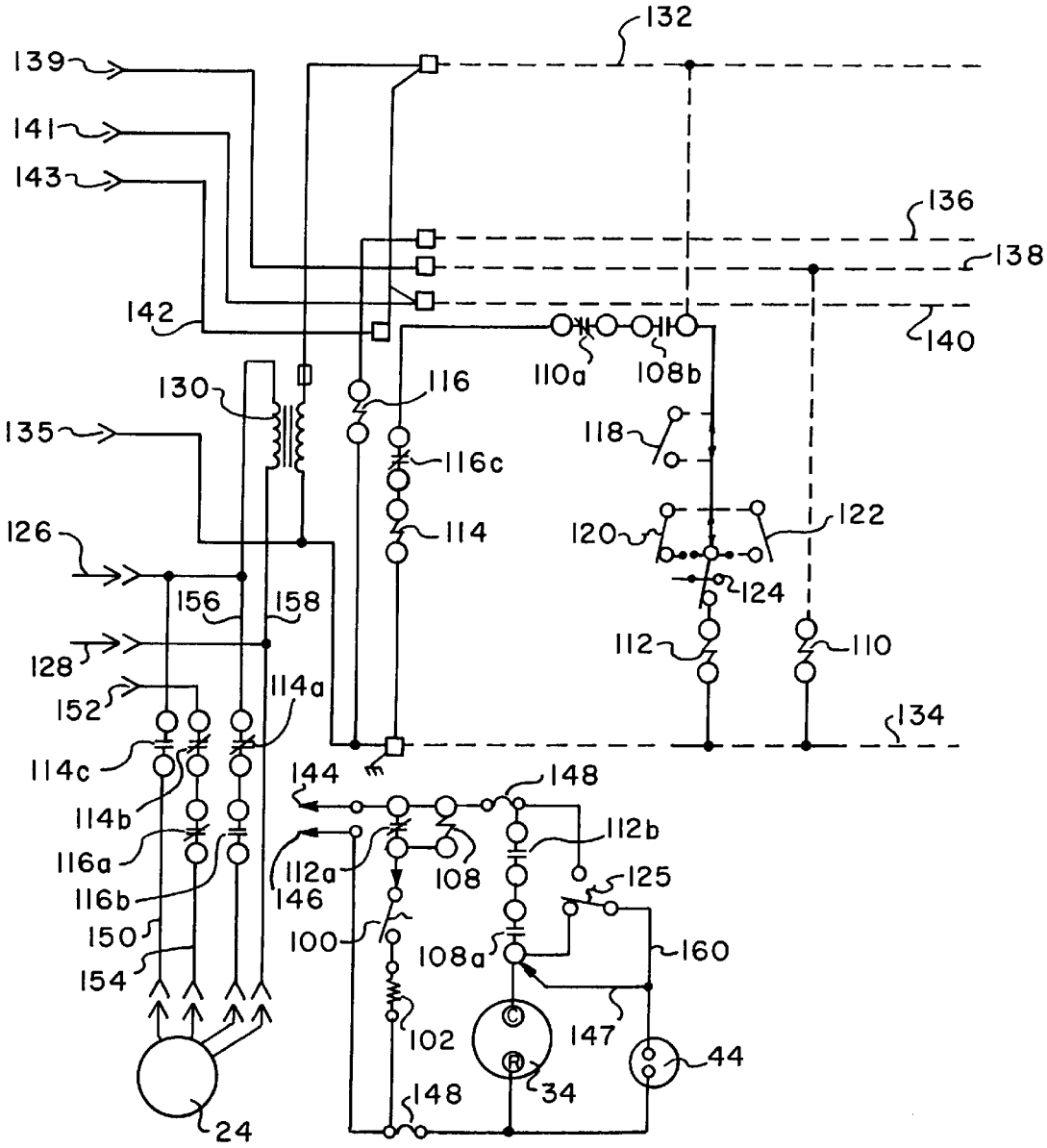
FIG. 3 is an electrical schematic of a circuit used to control operation of the water heating apparatus.

In accordance with the present invention, heat pump module 14 operates to remove heat from return air stream 20 and transfer it to the water flowing through coil 36*b*, thereby providing "free" cooling of return air stream 20 as a by-product of the water heating process, which reduces the cooling load on space conditioning system 10. The operation of water heating apparatus 12 will now be described in greater detail with reference to FIG. 3 Referring to FIGS. 1 and 3, the electrical circuit which controls the operation of water heating apparatus 12 will now be described. The electrical circuit in effect functions as a control device for water heating apparatus 12 and for blower 24. Tank 17 (FIG. 1) includes at least one first thermostat 100 and at least one electrically resistive heating element 102 for heating the water stored in tank 17 when electrical current flows through element 102. Typically, two thermostats 100 and two heating elements 102 are operably associated with tank 17, one thermostat 100 and one heating element 102 for a top part of tank 17 and one thermostat 100 and one heating element 102 for a bottom part thereof. However, for the sake of simplicity, only one thermostat 100 and one heating element 102 will be referred to herein. In an alternative embodiment, thermostat 100 may be located external to tank 17 for measuring the temperature of the heated water in line 48 (FIG. 1).

The control circuit includes relays 108, 110, 112, 114, 116. Relay 108 has two sets of contacts 108*a*, 108*b* associated therewith. Relay 110 has one set of contacts 110*a* associated therewith. Relay 112 has two sets of contacts 112*a*, 112*b* associated therewith. Relay 114 has three sets of contacts 114*a*, 114*b*, 114*c* associated therewith. Relay 116 has three sets of contacts 116*a*, 116*b*, 116*c* associated therewith. The control circuit further includes a manually operable on-off switch 118, a second thermostat 120 for measuring outdoor air temperature, a manually operable switch 122 for bypassing thermostat 120, a high pressure cut-out switch 124 and an third thermostat 125 for anti-freeze protection.

Blower 24 and compressor 34 are powered by line voltage (e.g., 230 VAC). The power supply for blower 24 is applied to leads 126, 128, which also supply line voltage to a transformer 130. Transformer 130 is a step-down transformer for converting line voltage to a lower voltage (e.g., 24 VAC) used for control signals. The lower voltage is applied to conductor 132. Conductor 134 functions as a common conductor. Conductors 136, 138, 140 transmit signals from an indoor thermostat (not shown) associated with space conditioning system 10 (FIG. 1). Assuming space conditioning system 10 is a heat pump, an electrical signal is transmitted on conductor 136 in response to a demand for either space heating or space cooling. A demand for first-stage space heating is transmitted on conductor 138, a demand for second-stage space heating is transmitted on conductor 140 and a demand for third-stage space heating is transmitted on conductor 142. Conductors 138, 140, 142 are coupled to sequential relays (not shown) associated with plural electrically resistive heating elements (not shown) located within cabinet 22 (FIG. 1) for operating the heating elements in a staged sequence for supplemental space heating. Conductors 138, 140, 142 are coupled to the aforementioned sequential relays via respective leads 139, 141, 143. Common conductor 134 is also coupled to the sequential relays via lead 135.

Line voltage is also applied to leads 144, 146. Relay 108 and contacts 112*a* are in parallel, but are each in series with switch 100 and heating element 102. Contacts 112*a* are normally closed. Further, during normal operation, switches 118, 120, 124 are also closed, such that relay 112 is normally energized. When relay 112 is energized, contacts 112*a* are open, thereby preventing electrical current from being supplied to heating element 102, except when relay 108 is energized. Further, when relay 112 is energized, normally open contacts 112*b* are closed.

Upon demand for water heating, thermostat switch 100 closes, thereby energizing relay 108, which closes normally open contacts 108*a* and normally open contacts 108*b*. Contacts 108*a* are in series with contacts 112*b* so that when contacts 108*a* are closed, power is supplied to a common terminal C of compressor 34. Electrical power is supplied directly to a run terminal R of compressor 34 via lead 146 so that the closure of contacts 108*a* starts compressor 34. Line voltage is also supplied to pump 44 when contacts 108*a* and 112*b* are closed via conductor 147, such that pump 44 is started substantially simultaneously with compressor 34. A two-pole circuit breaker 148 is interposed in leads 144, 146 to protect the electrical components.

As previously mentioned, upon a demand for water heating, relay 108 is energized, which closes contacts 108*a*, 108*b*. Closure of contacts 108*b* causes electrical current to flow from lower voltage conductor 132 through normally closed contacts 110*a*, 116*c*, thereby energizing relay 114. When relay 114 is energized, normally closed contacts 114*a*, 114*b* are opened and normally open contacts 114*c* are closed, thereby supplying line voltage from lead 126 to a low speed terminal of blower 24 via conductor 150. Therefore, in the absence of a demand for space heating or cooling, but when a demand for water heating is present, blower 24 is operated at low speed. Due to the relatively high resistance of relay 108, there is sufficient voltage drop across relay 108, such that the electrical current flow through heating element 102 is negligible.

If either high pressure switch 124 opens, indicating a high pressure condition in discharge line 40 (FIG. 1), or thermostat 120 opens, indicating a low outdoor air temperature condition, relay 112 is de-energized, thereby closing contacts 112*a* and opening contacts 112*b*. Closure of contacts 112*a* allows electrical current to flow through heating element 102 when there is a demand for water heating (i.e., when thermostat switch 100 is closed), such that the water in tank 17 is heated by heating element 102. Opening of contacts 112*b* disables compressor 34.

Relay 110 is coupled between conductor 138 and common conductor 134. When there is a demand for first-stage space heating, an electrical signal is present on conductor 138, which energizes relay 110. When relay 110 is energized, normally closed contacts 110*a* are opened, thereby de-energizing relay 114. When relay 114 is de-energized, contacts 114*a*, 114*b* are closed and contacts 114*c* are opened.

When space conditioning system 10 (FIG. 1) is a heat pump and there is a demand either for space heating or space cooling, a signal is generated on conductor 136, which energizes relay 116. The indoor thermostat may also include the capability to indicate first and second stage cooling demand on separate conductors, which are not shown on FIG. 3. When relay 116 is energized, normally open contacts 116*b* are closed and normally closed contacts 116*a*, 116*c* are opened, such that line voltage is supplied via lead 126 and conductor 156 to a high speed terminal of blower 24 to operate blower 24 at high speed in response to a demand for space heating or cooling, irrespective of whether there is also a demand for water heating. A demand for space heating or cooling therefore overrides a demand for water heating as far as speed of operation of blower 24 is concerned. Lead 128 is connected to a common conductor 158 of blower 24.

Thermostat 125 is in series with pump 44 via conductor 160 and is disposed to measure outdoor air temperature. When thermostat 125 closes due to the outdoor air temperature being below a predetermined temperature (e.g., 43° F.), pump 44 is connected to line voltage on lead 144 via conductor 160, thereby bypassing contacts 112*b*, 108*a*, so that pump 44 is operated to circulate water between tank 17 and heat pump module 14, even in the absence of a demand for water heating. Switch 122 is a manual override switch, which enables a user to bypass thermostat 120, to allow water heating apparatus 12 to be operated even when thermostat 120 is open due to a low outdoor air temperature condition. Unless override switch 122 is manually closed, a low outdoor air temperature condition (e.g., below 55° F.) will automatically disable operation of heat pump module 14, as described hereinabove, and trigger operation of electrically resistive heating element 102 in response to a demand for water heating.

When any of the supplemental heating elements located in cabinet 22 (FIG. 1) is activated, line voltage is applied to lead 152. Contacts 116*a* are closed in the absence of a demand for heating or cooling. When contacts 114*b* are also closed (i.e., in the absence of a demand for water heating) line voltage is supplied via lead 152 and conductor 154 to a medium speed terminal of blower 24, such that blower 24 is operated at medium speed in the absence of both a demand for space heating or cooling and a demand for water heating. Although not shown, lead 152 is connected to line voltage via normally open relay contacts (not shown), which are closed when any of the supplemental heating elements is activated.

The best mode for carrying out the invention has now been described. Since changes in and/or additions to the above-described best mode may be made without departing from the nature, spirit or scope of the invention, the invention is not to be limited to the above-described details, but only by the appended claims and their equivalents.

We claim:

1. In combination:

a system for temperature conditioning an indoor space, said system comprising:

first and second heat exchangers;

a first circulation device operable to circulate a first heat transfer fluid in a first circuit between said first and second heat exchangers; and a fluid moving device operable to supply a stream of conditioning fluid to the indoor space at first and second flow rates, said first flow rate corresponding to a lower flow rate than said second flow rate, said first heat exchanger being disposed to transfer heat between the stream of conditioning fluid and the first heat transfer fluid, whereby the stream of conditioning fluid is temperature conditioned before entering the indoor space;

heat pump apparatus for heating liquid, said apparatus comprising:

a third heat exchanger;

a second circulation device operable to circulate a second heat transfer fluid in a second circuit between the stream of conditioning fluid and said third heat exchanger, whereby heat is transferred from the stream of conditioning fluid to the second heat transfer fluid;

a third circulation device operable to circulate liquid to be heated in a third circuit through said third heat exchanger, whereby heat is transferred from the second heat transfer fluid to the liquid in said third heat exchanger; and a control device operable to control said second circulation device to circulate said second heat transfer fluid in said second circuit and said third circulation device to circulate liquid to be heated in said third circuit in response to a demand for liquid heating, said control device being further operable to control said fluid moving device to supply said stream of conditioning fluid at said first flow rate in response to said demand for liquid heating when said first circulation device is not being operated and to control said fluid moving device to supply said stream of conditioning fluid at said second flow rate when said first circulation device is being operated, irrespective of whether said demand for liquid heating is present.

2. The combination of claim 1 wherein said fluid moving device is an air blower and said stream of conditioning fluid is a return air stream, said blower being operable at first and second speed settings, said first speed setting corresponding to said first flow rate and said second speed setting corresponding to said second flow rate, said control device being adapted to operate said blower at said first speed setting in response to said demand for liquid heating in the absence of a demand for space conditioning, said control device being further adapted to operate said blower at said second speed setting in response to said demand for space conditioning, irrespective of whether said demand for liquid heating is present.

3. The combination of claim 2 further including a tank for storing heated liquid, said tank having an electrically resistive heating element operably associated therewith for heating liquid stored in said tank, said tank further including a temperature sensor adapted to sense temperature of the heated liquid and to generate a signal indicating said demand for liquid heating in response to the temperature of the heated liquid being below a predetermined temperature, said system further including a pressure sensor adapted to measure pressure in said second circuit on a discharge side of said second circulation device and to generate a high pressure signal in response to measured pressure exceeding a predetermined pressure, said control device being operable to disable said second and third circulation devices and to enable said heating element in response to the presence of both said high pressure signal and said signal indicating said demand for liquid heating.

4. The combination of claim 1 further including a tank for storing heated liquid, said tank having an electrically resistive heating element operably associated therewith for heating liquid stored in said tank, said apparatus further including a first temperature sensor adapted to sense temperature of the heated liquid and to generate a signal indicative of said demand for liquid heating in response to the temperature of the heated liquid being below a predetermined first temperature, said apparatus further including a second temperature sensor adapted to measure outdoor air temperature and to generate a low air temperature signal in response to outdoor temperature being below a predetermined second temperature, said control device being adapted to disable operation of said second and third circulation devices and to enable operation of said heating element in response to the presence of both said low air temperature signal and said signal indicating said demand for liquid heating.

5. The combination of claim 4 further including a manually operable switch positionable in open and closed positions, said control device being adapted to enable operation of said second and third circulation devices in response to said demand for liquid heating when said manually operable switch is in said closed position, irrespective of whether said low air temperature signal is present.

6. Heat pump apparatus for heating liquid, said apparatus comprising:

a heat transfer fluid-to-liquid heat exchanger;

heat transfer fluid circulation means for circulating heat transfer fluid between a return fluid steam of a primary source of space conditioning and said heat exchanger;

a tank for storing heated liquid;

liquid circulation means for circulating liquid to be heated between said heat exchanger and said tank;

a first temperature sensor adapted to sense temperature of the heated liquid and to generate a demand for liquid heating signal in response to the temperature of the heated liquid being below a predetermined first temperature;

an electrically resistive heating element operably associated with said tank and being adapted to heat liquid stored in said tank;

a control device adapted to enable operation of said heat transfer fluid circulation means and said liquid circulation means, whereby heat is transferred from the return fluid stream to the liquid., and to disable operation of said heating element in response to said demand for a liquid heating signal; and a second temperature sensor adapted to measure outdoor air temperature and to generate a low air temperature signal in response to the outdoor air temperature being below a predetermined second temperature, said control device being further adapted to disable operation of said heat transfer fluid circulation means and said liquid circulation means and to enable operation of said heating element in response to the presence of both said demand for liquid heating signal and said low air temperature signal.

7. Apparatus of claim 6 further including a manually operable switch positionable in open and closed positions, said control device being further adapted to enable operation of said heat transfer fluid circulation means and liquid circulation means in response to said demand for liquid heating signal when said manually operable switch is in said closed position, irrespective of whether said low air temperature signal is present.

8. Apparatus of claim 6 further including a pressure switch adapted to measure pressure on a discharge side of said heat transfer fluid circulation means and to generate a high pressure signal in response to the measured pressure exceeding a predetermined pressure, said control device being further adapted to disable said heat transfer fluid circulation means and liquid circulation means and to enable said heating element in response to the presence of both said high pressure signal and said demand for liquid heating signal.

9. Apparatus of claim 6 wherein said first temperature sensor is disposed to measure temperature of the liquid stored in said tank.

10. Apparatus of claim 6 wherein said first temperature sensor is disposed to measure temperature of the liquid and external to said tank.

11. Apparatus of claim 6 wherein said first temperature sensor is a first thermostat having a first setpoint temperature corresponding to said first temperature and said second temperature sensor is a second thermostat having a second setpoint temperature corresponding to said second temperature.

12. Apparatus of claim 11 further including a third thermostat having a third setpoint temperature, said third thermostat being disposed to measure outdoor air temperature and to operate said liquid circulation means to circulate liquid in response to the outdoor air temperature being below said third setpoint temperature, which is lower than said second setpoint temperature, irrespective of whether said demand for liquid heating signal is present.

13. Apparatus of claim 6 further including a third temperature sensor disposed to measure outdoor air temperature and to operate said liquid circulation means to circulate liquid in response to the outdoor air temperature being below a predetermined third temperature, irrespective of whether said demand for liquid heating signal is present.

14. Heat pump apparatus for heating liquid, said apparatus comprising:

a heat transfer fluid-to-liquid heat exchanger;

heat transfer fluid circulation means for circulating heat transfer fluid between a return fluid stream of a primary source of space conditioning and said heat exchanger;

a tank for storing heated liquid;

liquid circulation means for circulating liquid to be heated between said heat exchanger and said tank;

a control device adapted to enable operation of said heat transfer fluid circulation means and said liquid circulation means in response to a demand for liquid heating, whereby heat is transferred from the return fluid stream to the liquid via the heat transfer fluid; and a temperature sensor located to measure outdoor air temperature, said control device being operable to activate said liquid circulation means to circulate liquid in said second circuit in response to the outdoor air temperature being below a predetermined temperature, irrespective of whether said demand for liquid heating is present.

* * * * *